US006051357A

United States Patent [19]

Matsui et al.

[11] Patent Number: 6,051,357

[45] Date of Patent: Apr. 18, 2000

[54] PHOTOCONDUCTOR FOR ELECTROPHOTOGRAPHY

[75] Inventors: Naoyuki Matsui; Yasufumi Kakihana, both of Niigata, Japan

[73] Assignee: NEC Corporation, Tokyo, Japan

[21] Appl. No.: 08/972,886

[22] Filed: Nov. 18, 1997

[30] Foreign Application Priority Data

Nov. 19, 1996 [JP] Japan ..... 08-308084

[51] Int. Cl.[7] ..... G03G 5/10

[52] U.S. Cl. ..... 430/131; 430/65; 430/69

[58] Field of Search ..... 430/65, 69, 131

[56] References Cited

U.S. PATENT DOCUMENTS

| | | | |
|---|---|---|---|
| 4,800,144 | 1/1989 | Ueda | 430/65 |
| 5,434,027 | 7/1995 | Oshiba et al. | 430/59 |
| 5,783,344 | 7/1998 | Kobayashi et al. | 430/65 |
| 5,908,724 | 6/1999 | Matsui | 430/65 |

FOREIGN PATENT DOCUMENTS

| | | |
|---|---|---|
| 4-233550 | 8/1992 | Japan . |
| 7-84391 | 3/1995 | Japan . |
| 7-295266 | 11/1995 | Japan . |
| 8-248662 | 9/1996 | Japan . |
| 8-26774 | 10/1996 | Japan . |
| 8-278652 | 10/1996 | Japan . |
| 9-54452 | 2/1997 | Japan . |
| 9-244288 | 9/1997 | Japan . |

OTHER PUBLICATIONS

Grant, R. et al. Ed, *Grant & Hackh's Chemical Dictionary*, Fifth Edition, McGraw–Hill Book Company, NY (1987), pp. 626–627.

Patent & Trademark Office English–Language Translation of JP 7–295266 (Pub Nov. 10, 1995).

Japanese Office Action, dated Jan. 19, 1999, with English Language Translation of Japanese Examiner's comments.

*Primary Examiner*—Janis L. Dote
*Attorney, Agent, or Firm*—Whitham, Curtis & Whitham

[57] ABSTRACT

An electrophotography photoconductor has a conductive substrate and an anodic oxidation layer on which a photoconductive layer is formed. The sealed surface of the anodic oxidation has an admittance ranging from 0.4 $S/m^2$ to 30 $S/m^2$ and a contact angle of pure water ranging 30° to 80°. The surface of the anodic oxidation layer is sealed by dipping it into a nickel acetate solution. The contact angle and the admittance are determined depending on a temperature of the nickel acetate solution and a sealing time. In the case where the sealed surface is irradiated with ultraviolet rays, the heat-resisting property and cleanliness are improved.

10 Claims, 1 Drawing Sheet

PHOTOCONDUCTOR FOR ELECTROPHOTOGRAPHY

BACKGROUND OF THE INVENTION

1. Field of the Invention

The present invention relates to a photoconductor for electrophotography to be used for forming images by an electrophotographic process such as a copying machine, a printer, a facsimile, etc., and a method of manufacturing the photoconductor.

2. Description of Related Art

In an image forming system using an electrophotographic photoconductor, after electrically charging the surface of the photoconductor having a photo conductivity by means of corona discharging or the like, an electrostatic latent image is formed thereon by image exposure, and finally a visual image is developed with toner.

What becomes a problem in the electrophotographic photoconductor used in this system is a local charging failure due to a defect of the photoconductor, and this results in an extremely poor image such as a black point or a fog in the image. Various factors can be considered as causes for an occurrence of such a local charging failure, and most of the failures are considered to occur due to a local charge injection between a conductive supporter and a photoconductive layer.

Most of the conductive supporters use aluminum or an alloy including aluminum as a main component for a substrate, and a blocking layer is provided between the aluminum substrate and a photoconductive layer to prevent an occurrence of the problem. As known techniques, there have been methods for providing resin layers of polyamide, polyimide, polyvinylalcohol, polyurethane, casein, cellulose, etc. and inorganic layers of aluminum oxide, aluminum hydroxide, etc. A method of providing an inorganic layer, or an anodic oxidation (or anodized) layer, as a blocking layer is used with a view to improving a close adhesion of a photoconductive layer and facilitating the cleaning as well as preventing a reduction in the drop of a charged level.

Further, in recent years, organic materials have been widely used for photoconductive layers. This is because organic materials have such advantages as their low materials costs, low manufacturing costs and no environmental problems involved. These organic materials are coated in points or coatings on an anodic oxidation layer by a dip coating method and a ring coating method. In order to form a uniform and stable photoconductive layer, it is necessary that the coating has both excellent dispersiveness and solubility. In order to meet this requirement, various kinds of solvents have been used in the coatings, and particularly, the use of a high boiling-point solvent has been investigated. When a high boiling-point solvent is used, a drying process at high temperature is naturally required in order to eliminate solvent components by evaporation.

However, even if an electrophotography photoconductor having the above-described blocking layer is used, it is difficult to achieve an improvement of completely eliminating the image defects such as back points and fog. Particularly, the occurrence of a fog is extreme under the environment of high temperature and high humidity.

Further, an anodic oxidation layer is gradually oxidized naturally and its heat-resisting property is deteriorated along with the lapse of time. When the heat-resisting property is deteriorated, various problems, such as cracks occur on the surface of the layer during a drying process, uneven coating at the time of forming a photoconductive layer, dielectric breakdown strength is lowered, cracks occur increasingly in the photoconductive layer, etc.

Moreover, because of a porous surface state of the anodic oxidation layer, a contamination in the air once adsorbed on this surface is difficult to be removed. Even if the layer is tried to be cleaned with a liquid such as an organic solvent or the like, the liquid cannot be removed completely after the cleaning, with a fine quantity of the liquid remaining on the layer as a result. The cleaning of the anodic oxidation layer with a liquid solvent results in a rapidly progressive oxidation of the layer surface, which further increases the possibility of occurrence of cracks on the layer.

Further, in Japanese Patent Application Examined Publication No. 7-120062, there is disclosed an electrophotography photoconductor having an anodic oxidation layer which has been seal processed and which has a product of Ym×d as not more than $4\times10^{-10}$ (S.m), where d represents an average layer thickness of the anodic oxidation layer and Ym represents admittance, in order to solve the problems of black points and fogging.

SUMMARY OF THE INVENTION

It is an object of the present invention to provide an electrophotography photoconductor and a manufacturing method thereof which can achieve improved heat-resisting and charging properties and can form a high-quality image thereon.

It is another object of the present invention to provide an electrophotography photoconductor which can obtain a satisfactory image under any environment in which the electrophotography photoconductor is used, and a method for manufacturing this electrophotography photoconductor.

According to an aspect of the present invention, a blocking layer is formed on a conductive substrate and the surface of the blocking layer has a wettingness represented by a contact angle of pure water which is 30 to 80° and an admittance which is 0.4 to 30 $S/m^2$.

The blocking layer may be an anodic oxidation layer formed on the conductive substrate which may be made of aluminum or an aluminum alloy. In this case, the surface of the anodic oxidation layer may be sealed by, for example, a nickel acetate solution. The contact angle and the admittance are determined depending on the sealing temperature and the sealing time. the sealing temperature may range from 50 to 75° C. and the sealing time may range from four to ten minutes.

According to another aspect of the present invention, after forming an anodic oxidation layer on a conductive substrate, the surface of the anodic oxidation layer is irradiated with ultraviolet rays. The contact angle of pure water with the surface of the anodic oxidation layer after the ultraviolet irradiation is 30 to 80°, and the admittance is equal to or greater than 0.4 $S/m^2$.

As a result of investigations carried out for solving the problem of an occurrence of a printing defect due to a local defect or an occurrence of fogging under a high-temperature and high-humidity environment, it has been possible to obtain an electrophotography photoconductor for showing satisfactory image characteristics by using a specific anodic oxidation layer formed on a conductive substrate.

Further, there has been found a step of an ultraviolet ray irradiation for improving both heat-resisting property and cleanliness which is effective for an aluminum substrate of which heat-resisting property has been lowered by a natural oxidation of the surface of the anodic oxidation layer.

It has also been found that when a conductive substrate made of aluminum or aluminum alloy is used of which heat-resisting property has been lowered by a progressive natural oxidation of the surface of the aluminum substrate due to a storage for a long period or due to a cleaning processing of the aluminum substrate, there is an effect of removing a remaining fine quantity of impurities from the surface of the anodic oxidation layer by irradiating ultraviolet rays onto it after the surface has been cleaned with a liquid for completely removing organic impurities such as a contamination while preventing a progress of oxidation of the surface of the anodic oxidation layer, so that the oxidized surface can be returned to an original activated state.

DETAILED DESCRIPTION OF THE PREFERRED EMBODIMENTS

Figure 1:
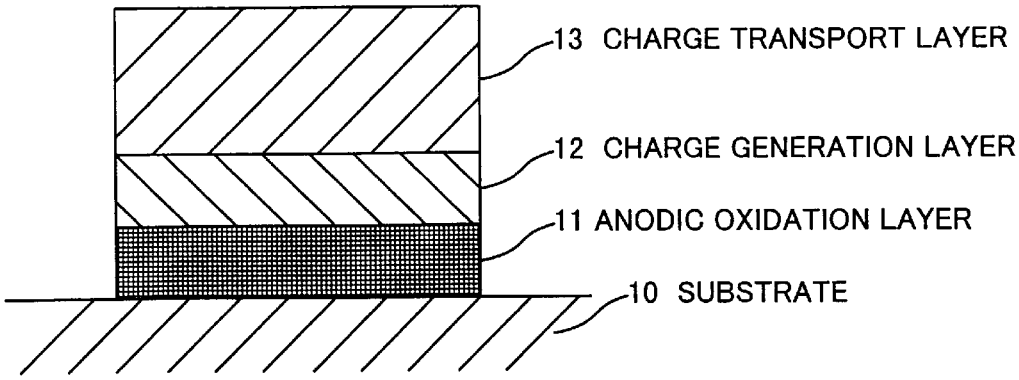
FIG. 1 is a schematic sectional diagram showing a structure of an electrophotography photoconductor according to the present invention.

Referring to FIG. 1, the electrophotography photoconductor is composed of an aluminum substrate 10, an anodic oxidation layer 11, and a photoconductive layer laminated on the anodic oxidation layer 11, the photoconductive layer including a charge generation layer 12 and a charge transport layer 13. The electrophotography photoconductor is structured by forming the anodic oxidation layer 11 with a specific manner on the aluminum substrate 10 and then forming the photoconductive layer on the anodic oxidation layer 11.

As a material for the aluminum substrate 10, an aluminum alloy of an Al—Mg—Si system, an Al—Mn system, etc. can also be used instead of a pure Al group. It is desirable that the aluminum substrate 10 is defatted by an organic solvent such as alkylene, or by a surfactant or an emulsified defatting agent and then is etched before the anodic oxidation.

The anodic oxidation layer 11 is formed by a known method like an anodic oxidization method in an acid bath such as, for example, sulfuric acid, oxalic acid, chromic acid, boric acid, etc. When the anodic oxidation layer is anodized in sulfuric acid, it is desirable that the density of sulfuric acid is set at 100 to 200 g/l, the density of aluminum ion is set at 1 to 10 g/l, the liquid temperature is set at around 25° C., and the electrolytic voltage is set at approximately 20 V, respectively. However, these conditions are not limited.

The formed anodic oxidation layer is seal processed by dipping it into an aqueous solution including nickel acetate, by setting the density of the solution at 5 to 10 g/l and the processing temperature at 50 to 75° C. for a processing time of four to ten minutes, with the pH set within a range from 4 to 6. The layer thickness of the anodic oxidation layer is set at not more than 20 $\mu$m, preferably at a value within a range from 5 to 10 $\mu$m. The anodic oxidation layer 11 formed in this way is cleaned with pure water to the like based on the need.

The admittance of the anodic oxidation layer 11 formed as described above is measured in the following manner. A non-conductive cell is fitted on the surface of a sample under the environment of an ordinary temperature and a potassium sulfate aqueous solution of 3.5 parts by weight is filled in a cell and this is left for thirty minutes in this condition. Then, one of the electrodes of an admittance measuring apparatus is connected to the ground, with the other electrode inserted into the cell filled with the aqueous solution, and the admittance is measured at the frequency of 1 KHz. It is determined whether a measured admittance value falls within the range from 0.4 to 30 S/m$^2$ depending on a relationship between the seal processing temperature and the dipping time. Further, the relationship between the seal processing temperature and the dipping time is determined by taking into account the fact that the contact angle of pure water with the surface of the anodic oxidation layer is within the range from 30° and 80°.

Figure 2:
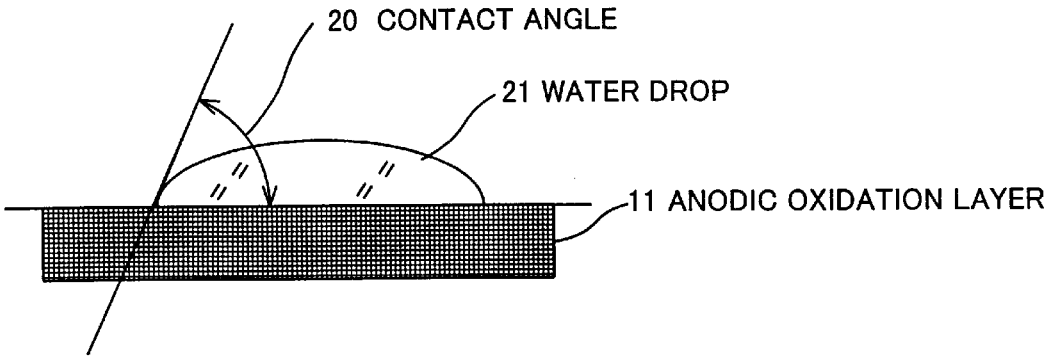
FIG. 2 is a schematic diagram for explanation of a contact angle.

As shown in FIG. 2, a contact angle 20 is used to evaluate the wettingness of the surface of the anodic oxidation layer 11, and an angle formed by a water drip 21 dropped on the surface of the anodic oxidation layer 11 is defined as the contact angle 20.

On the anodic oxidation layer 11 as described above, the charge generation layer 12 and the charge transport layer 13 which are made of organic materials forming the photoconductive layer to be described later are sequentially laminated. In order to form uniform and stable lamination, a coating having satisfactory dispersiveness and solubility becomes necessary. For this purpose, various solvents, particularly high boiling-point solvents, are being used, and thus it becomes essential to have a drying process at a high temperature in order to remove solvent components. As a result of investigations carried out for finding a condition under which no cracks occur on the surface of the anodic oxidation layer, it has been found that the admittance requires at least 0.4 S/m$^2$.

The photoconductive layer to be provided on the anodic oxidation layer 11 include at least the charge generation layer 12 and the charge transport layer 13 to be laminated in sequence, and it is also possible to provide various kinds of intermediate layers between the anodic oxidation layer 11 and the photoconductive layer. More specifically, as the intermediate layer, there may be included polyamide, polyvinyl alcohol, polyurethane, polyacrylic acid, and an epoxy resin, or with additives of various kinds such as conductive particles mixed in these resins. The intermediate layer may be either in a single layer or in a lamination of at least two layers. A suitable thickness of the intermediate layer is within the range from 0.1 to 10 $\mu$m, preferably 0.2 to 4 $\mu$m.

For the charge generation layer 12, known charge generating materials are used, for example, a metal-free phthalocyanine pigment, a metal phthalocyanine pigment, an azo pigment, a diazo pigment, an indigo pigment, a quinacridon pigment, etc. These charge generating materials can be used as one kind or two or more kinds of pigment in combination. To form the charge generation layer 12, the charge generating materials are dispersed in a binder resin. As the binder resin, there may be used a PVC resin, a polyvinyl acetate resin, a polyvinyl butyral resin, a polyvinyl formal resin, a polyester resin, a polyurethane resin, a polycarbonate resin, an acrylic resin, a phenolic resin, etc. as a single resin or two or more resins in combination.

The charge generation layer 12 is formed by coating a coating material prepared by solving or dispersing the charge generating material and the binder resin into a solvent such as toluene, xylene, monochlorobenzene, methyl alcohol, ethyl alcohol, ethyl acetate, methyl chloride, tetrahydrofuran, cyclohexane, etc. These solvents can be used as a single solvent or as a mixture. For coating these coating materials, known coating methods are used such as spin coater, applicator, spray coater, bar coater, dip coater, doctor blade, etc. A suitable layer thickness of the charge generation layer is 0.05 to 5 μm, preferably 0.1 to 2 μm.

The charge transport layer 13 to be formed on the charge generation layer 12 is formed by coating a coating material for the charge transport layer produced by solving or dispersing a charge carrying material and a binder resin for disperse fixing the charge carrying material into a solvent. As the coating material for the charge transport layer, such additives as an antioxidant, a surfactant, an ultraviolet rays absorbent, etc. can be used.

As the charge carrying material, there may be used such known materials as poly-N-vinyl carbazole and its derivatives, pyrene formaldehyde condensate and its derivatives, polysilane and its derivatives, oxazole derivatives, oxadiazole derivatives, monoarylamine derivatives, diarylamine derivatives, triarylamine derivatives, stilbene derivatives, benzidine derivatives, pyrazoline derivatives, hydrazone derivatives, butadiene derivatives, etc. The charge carrying materials can be used as a single kind or two or more kinds in combination.

As the binder resin for disperse fixing the charge carrying material, there may be used a PVC resin, a polyvinyl acetate resin, a polyvinyl butyral resin, a polyvinyl formal resin, a polyester resin, a polyurethane resin, a polycarbonate resin, an acrylic resin, a phenolic resin, etc. as a single resin or two or more resins in combination.

As the solvent, there may be used toluene, xylene, monochlorobenzene, methyl alcohol, ethyl alcohol, ethyl acetate, methyl chloride, tetrahydrofuran, cyclohexane, etc. These solvents can also be used as a single solvent or as a mixture.

A suitable layer thickness of the charge transport layer 13 is 5 to 40 μm, preferably 15 to 25 μm. As a method for coating the charge transport layer, known coating methods are used such as spin coater, applicator, spray coater, bar coater, dip coater, doctor blade, etc.

The electrophotography photoconductor obtained in the manner as described above has satisfactory image characteristics without any defect such as an occurrence of a fine black point or fogging under broad using conditions including a high-temperature and high-humidity condition, and is excellent in heat resistivity as well.

Embodiments of the present invention will now be explained in detail, and the present invention is not limited to the below-mentioned embodiments so long as it does not exceed the scope of the object of the invention.

(EXAMPLE 1)

A mirror-finished cylindrical pipe made of an aluminum alloy of an Al—Si—Mg system having a diameter of 80 mm and a thickness of 1.25 mm was defatted by an organic solvent, and then was etched. Subsequently, after cleaning the pipe with water, the pipe was anodized for fifteen minutes at a DC voltage of 20 V and at a liquid temperature of 25° C. by using sulfuric acid of 150 g/l as an electrolytic solution. As a result, an anodic oxidation layer of an average layer thickness of 7 μm was formed.

Next, after having been cleaned with water, the pipe was dipped into an aqueous solution of a seal processing agent of 6 g/l including nickel acetate as a main component at 55° C., and was seal processed for five minutes in the dipped state. Then, the pipe was cleaned with water sufficiently, followed by drying.

An admittance measured per unit area of the anodic oxidation layer obtained in this way was 9.0 $S/m^2$, and the contact angle of pure water was 65°. This is called as a substrate a.

Further, titanyl phthalocyanine of 2.5 parts by weight and polyvinyl butyral of 2 parts by weight were added to tetrahydrofuran of 100 parts by weight and this mixture was dispersed for twenty four hours in a ball mill. This dispersed coating was dipped for coating onto the substrate a, and the substrate was dried by heating to form a charge generation layer of approximately 0.2 μm.

Next, the charge carrying material of 20 parts by weight as shown below and polycarbonate (Z-200, manufactured by Mitsubishi Gas Chemical Co., Ltd.) of 20 parts by weight were solved in methyl chloride of 100 parts by weight, and this solution was dipped for coating onto the charge generation layer 12, and then was dried by heating to form a charge transport layer 13 of approximately 20 μm, so that an electrophotography photoconductor was produced. The electrophotography photoconductor obtained in this way is called a drum A.

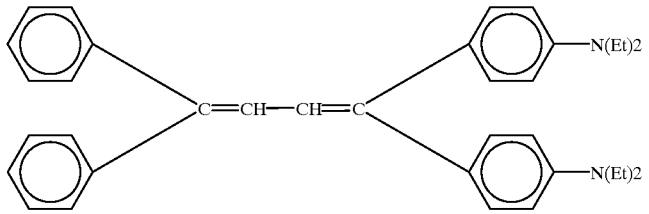

(EXAMPLE 2)

An anodic oxidation layer was formed and then dried in a manner similar to that of the embodiment 1, and this layer was seal processed by dipping this layer into an aqueous solution using a sealing agent of 6 g/l including nickel acetate as a main component for seven minutes at a temperature of 65° C. and then the anodic oxidation layer was cleaned and dried.

An admittance measured per unit area of the anodic oxidation layer obtained in this way and the contact angle of pure water were measured as shown in Table 1. The substrate produced in this way is called substrate b.

Thereafter, an electrophotography photoconductor was produced in a manner similar to that of the Example 1, and it is called a drum B.

(EXAMPLE 3)

An anodic oxidation layer was formed and then dried in a manner similar to that of the embodiment 1, and this layer was sealed processed by dipping this layer into an aqueous solution using a sealing agent of 6 g/l including nickel acetate as a main component for seven minutes at a temperature of 50° C., and then the anodic oxidation layer was cleaned and dried.

An admittance measured per unit area of the anodic oxidation layer obtained in this way and the contact angle of pure water were measured as shown in Table 1. The substrate produced in this way is called substrate c.

Thereafter, electrophotography photoconductors were produced in a manner similar to that of the EXAMPLE 1, and it is called a drum C.

(COMPARATIVE EXAMPLE 1)

An anodic oxidation layer was formed and then dried in a manner similar to that of the EXAMPLE 1, and this layer was seal processed by dipping this layer into an aqueous solution of a sealing agent of 6 g/l including nickel acetate as a main component for six minutes at a temperature of 90° C., and then the anodic oxidation layer was cleaned and dried. An admittance measured per unit area of the anodic oxidation layer obtained in this way was 0.21 $S/m^2$ and the contact angle of pure water was 86°. This is called a substrate d. Thereafter, an electrophotography photoconductor was produced in a manner similar to that of the embodiment 1, and this is called a drum D as shown in Table 1.

(COMPARATIVE EXAMPLE 2)

An anodic oxidation layer was formed and then dried in a manner similar to that of the EXAMPLE 1, and this layer was cleaned with pure water and dried without a seal processing. An admittance measured per unit area of the anodic oxidation layer obtained in this way and the contact angle of pure water are as shown in Table 1. This is called a substrate e. Thereafter, an electrophotography photoconductor was produced in a manner similar to that of the embodiment 1, and this is called a drum E.

(COMPARATIVE EXAMPLE 3)

The substrate c produced in the embodiment 3 was stored for one month in a thermo-hygrostat at an adjusted temperature of 30° C. and an adjusted humidity of 60%, and this substrate is called a substrate f. An admittance measured per unit area of the anodic oxidation layer obtained in this way and the contact angle of pure water are as shown in Table 1. Thereafter, an electrophotography photoconductor was produced in a manner similar to that of the embodiment 1, and this is called a drum F.

(COMPARATIVE EXAMPLE 4)

An anodic oxidation layer was formed and then dried in a manner similar to that of the EXAMPLE 1, and this layer was seal processed by dipping this layer into an aqueous solution of a sealing agent of 6 g/l including nickel acetate as a main component for thirty minutes at a temperature of 65° C., and then the anodic oxidation layer was cleaned and dried. An admittance measured per unit area of the anodic oxidation layer obtained in this way and the contact angle of pure water are as shown in Table 1. This is called a substrate g. Thereafter, an electrophotography photoconductor was produced in a manner similar to that of the embodiment 1, and this is called a drum G.

TABLE 1

| Examples Of production | | Sub. | Seal Processing Temp. (° C.) | Sealing Time | Y $S/m^2$ | Contact angle (°) | DR |
|---|---|---|---|---|---|---|---|
| EXAMPLE | 1 | a | 55 | 5 minutes | 9.0 | 65 | A |
| | 2 | b | 65 | 7 minutes | 0.52 | 74 | B |
| | 3 | c | 50 | 7 minutes | 12.0 | 38 | C |
| Compara | 1 | d | 90 | 6 minutes | 0.21 | 86 | D |
| tive | 2 | e | No seal processing | | 85.1 | 14 | E |
| example | 3 | f | 50 | 7 minutes | 0.35 | 84 | F |
| | 4 | g | 65 | 30 minutes | 0.45 | 82 | G |

*Sub.: Substrate *DR: Drum *Y: Admittance

The substrates a to g produced in the manner as described above were heated for sixty minutes at 135° C. and then were suddenly cooled. This process was repeated by further two times and presence or absence of an occurrence of cracks was observed. A result of the observation is shown in Table 2.

TABLE 2

| Examples Of production | | Substrate | Heating-test (135° C./60 minutes × 3 cycles) | Heat resistivity |
|---|---|---|---|---|
| Example | 1 | a | No occurrence of cracks | ○ |
| | 2 | b | No occurrence of cracks | ○ |
| | 3 | c | No occurrence of cracks | ○ |
| Compara- | 1 | d | Occurrence of cracks | X |
| tive example | 2 | e | No occurrence of cracks | ○ |
| | 3 | f | Occurrence of cracks | X |
| | 4 | g | No occurrence of cracks | ○ |

Further, the drums A to G were mounted on a page printer (manufactured by NEC), and the potential of an exposed portion and the holding rate under the environment of a temperature of 25° C. and a humidity of 50% were measured, and image characteristics of the drums under various environments were evaluated. Results of the evaluation are shown in Tables 3 and 4.

TABLE 3

| Examples of production | | Drum | Potential characteristics of the drums (25° C./50% RH): Potential of exposed portion (−V) | Holding rate (%) |
|---|---|---|---|---|
| Example | 1 | A | 105 | 92.3 |
| | 2 | B | 89 | 90.4 |
| | 3 | C | 110 | 93.2 |
| Comparative | 1 | D | 78 | 76.4 |
| example | 2 | E | 138 | 70.3 |
| | 3 | F | 77 | 72.6 |
| | 4 | G | 76 | 77.6 |

TABLE 4

| Examples of production | | Drum | Evaluation of image characteristics 10° C./30% RH | 25° C./50% RH | 40° C./80% RH |
|---|---|---|---|---|---|
| Example | 1 | A | Satisfactory | Satisfactory | Satisfactory |
| | 2 | B | Satisfactory | Satisfactory | Satisfactory |
| | 3 | C | Satisfactory | Satisfactory | Satisfactory |
| Comparative example | 1 | D | Uneven coating with black points | Uneven coating with black points | Fogging and uneven coating with black points |
| | 2 | E | Uneven coating with many black point | Uneven coating with many black points | Uneven coating with many black points |
| | 3 | F | Satisfactory | Satisfactory | Fogging with many black points |
| | 4 | G | Satisfactory | many black points | Fogging with many black points |

It can be known from Tables 2 to 4 that while there were no occurrence of cracks due to the heating in the substrates a to c and e and g, many cracks occurred in the substrates d and f. Further, from the measurement of potentials at the exposed portion as one of the potential characteristics of the drums, it is known that the drum E has a low sensitivity as compared with the drums A to C. Looking at the holding rates as a yardstick of chargeability, the drums of the comparative examples D to G showed unsatisfactory values which all have problems in the image density.

From the result of the evaluation of image characteristics under various environments, it is known that while the drums A to C all obtained satisfactory images without an occurrence of fogging or black points under all the environments, the drums D to G of the comparative examples all showed an existence of a defect, particularly with an occurrence of serious fogging under a high-temperature and high-humidity environment, and these drums cannot be used in practice.

From the above results, it can be known that the heat-resistivity of the anodic oxidation layer becomes poor and cracks occur easily when the admittance of the anodic oxidation layer is less than 0.4 $S/m^2$. When the admittance of the anodic oxidation layer is greater than 80 $S/m^2$, the blocking effect cannot work sufficiently, so that a chargeability is deteriorated.

Further, the contact angle becomes a yardstick for checking the wettingness of the coating at the time of forming the photoconductive layer. When the contact angle is smaller than 30°, the adsorption ability becomes larger so that a contamination in the air can be easily adhered to the surface of the photoconductive layer and the leveling of the coating is restricted with a resultant easy occurrence of a defect such as an uneven coating and a black point. On the contrary, when the contact angle is larger than 80°, the adsorption ability becomes smaller with an easy leveling, but with an occurrence of an uneven coating despite an attempt to change the coating density and coating speed for keeping the image density.

Admittance and contact angle are in a trend of a proportional relationship with each other. However, when the admittance is high, there is small change in the admittance and only the contact angle changes with a lapse of time, and this becomes a problem in manufacturing an electrophotography photoconductor.

Another embodiment of the present invention will be described hereinafter.

As a pre-processing of photoconductive layer laminating, the anodic oxidation layer is cleaned to remove impurities remaining on its surface at the time of forming the anodic oxidation layer or impurities adhered to the surface of the anodic oxidation layer at the time of moving this layer or to remove a contamination adhered to the surface during a storage of the anodic oxidation layer for a long time. For this purpose, a sufficient cleaning power is necessary to physically remove impurities, and thus the anodic oxidation layer is cleaned with a liquid. As the liquid to be used for the cleaning, an organic solvent, a surfactant or an aqueous solution including these or pure water is used, each of which includes minimum volume of unnecessary impurities.

Next, the surface of the anodic oxidation layer is irradiated uniformly with wide-band ultraviolet rays for at least one minute in order to remove fine volume of impurities remaining at a fine portion.

Figure 3:
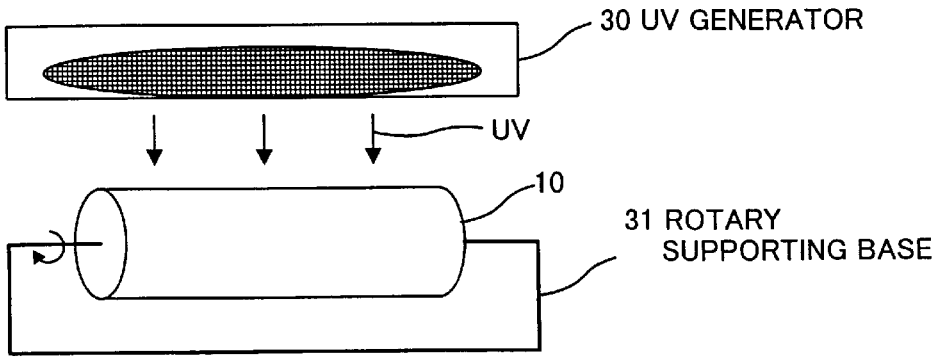
FIG. 3 is a schematic diagram showing an outline of an ultraviolet ray illuminating apparatus which is used to form the electrophotography photoconductor according to the present invention.

As shown in FIG. 3, as an outline, an illumination apparatus has an ultraviolet generator 30 from which ultraviolet rays are irradiated uniformly onto the aluminum substrate 10 supported by a rotary supporting base 31. Depending on the strength of the ultraviolet rays of the illumination apparatus, the time required for the illumination changes.

The magnitude of cleaning of the surface of the anodic oxidation layer 11 can be evaluated based on the measurement of the contact angle, and the value of the contact angle becomes smaller when impurities adhered to the surface have been removed. The solvent to be used for the measuring of the contact angle is selected based on a wettingness index standard liquid (manufactured by Wako Junyaku Kogyo Co., Ltd.) and the distribution of their values. A solvent of 70 dyne/cm or above at which values of a wider range can be measured is suitable for the measuring, for example, pure water is suitable.

As explained above, it becomes possible to remove fine quantity of impurities without deteriorating the heat-resisting property of the anodic oxidation layer formed on the substrate of the electrophotography photoconductor. It becomes possible to obtain the electrophotography photoconductor having excellent image characteristics free from any defect of a fine black point or others under all the environments, when the conditions are satisfied that the contact angle of pure water with the anodic oxidation layer is within the range from 30° to 80° and that the admittance is 0.4 $S/m^2$ or above.

(EXAMPLE 4)

A mirror-finished cylindrical pipe made of an aluminum alloy of an Al—Si—Mg system having a diameter of 30 mm and a thickness of 1.05 mm was defatted by an organic solvent, and then was etched. Subsequently, after cleaning the pipe with water, the pipe was anodized for fifteen minutes at a DC voltage of 20 V and at a liquid temperature of 25° C. by using sulfuric acid of 150 g/l as an electrolytic solution. As a result, an anodic oxidation layer of an average layer thickness of 6 $\mu$m was formed.

Next, after having been cleaned with water, the pipe was dipped into an aqueous solution of a seal processing agent of 6 g/l including nickel acetate as a main component at 70° C., and was seal processed for six minutes in the dipped state. Then, the pipe as cleaned with water sufficiently, followed by drying.

The aluminum substrate obtained in this way was fixed to a rotating stand and was rotated at 40 rpm, and in this state, ultraviolet rays were irradiated onto the whole substrate for two minutes (by using a low-pressure mercury lamp, with an UV output 12 mW/cm$^2$, manufactured by Sen Engineering Co., Ltd.). This substrate is called a substrate h. After the irradiation, an admittance measured per unit area of the anodic oxidation layer of the substrate h obtained was 0.75 S/m$^2$ and the contact angle of pure water was 48°.

Further, titanyl phthalocyanine of 2.5 parts by weight and polyvinyl butyral of 2 parts by weight were added to tetrahydrofuran of 100 parts by weight and this mixture was dispersed for twenty four hours in a ball mill. This dispersed coating was dipped for coating on the substrate h, and the substrate was dried by heating to form a charge generation layer 12 of approximately 0.2 $\mu$m.

Next, the charge carrying material of 20 parts by weight as shown below and polycarbonate (Z-200, manufactured by Mitsubishi Gas Chemical Co., Ltd.) of 20 parts by weight were solved in methyl chloride of 100 parts by weight, and the charge generation layer was dipped into this solution for coating on the charge generation layer, and then was dried by heating to form a charge transport layer of approximately 20 $\mu$m, so that an electrophotography photoconductor was produced. The electrophotography photoconductor obtained in this way is called a drum H.

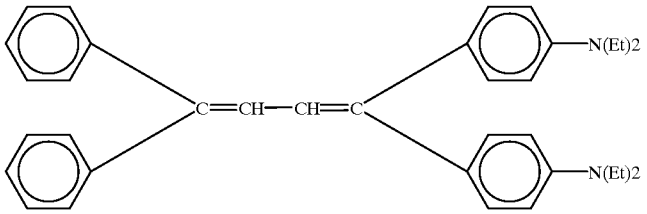

(EXAMPLE 5)

An anodic oxidation layer was formed in a manner similar to that of the EXAMPLE 4, and the layer was seal processed, cleaned and dried. The aluminum substrate obtained was stored for twenty four hours in a thermo-humidistat at an adjusted temperature of 80° C. and an adjusted humidity of 80%, and an acceleration test was carried out. Then, the aluminum substrate was cleaned with pure water, dried and was irradiated with ultraviolet rays for three minutes in a manner similar to that of the Example 4. This substrate is called a substrate i. An admittance measured per unit area of the anodic oxidation layer of the substrate i obtained after the irradiation and the contact angle of pure water are as shown in Table 5. Thereafter, an electrophotography photoconductor was produced in a manner similar to that of the Example 4, and this is called a drum I.

(EXAMPLE 6)

An anodic oxidation layer was formed and then dried in a manner similar to that of the EXAMPLE 4, and this layer was seal processed by dipping this layer into an aqueous solution of a sealing agent of 6 g/l including nickel acetate as a main component for five minutes at a temperature of 55° C., and then the anodic oxidation layer was cleaned and dried. An aluminum substrate thus obtained was sealed in a packaging box and was left for two months under the condition of a normal temperature and a normal humidity. After this period, the aluminum substrate was cleaned with pure water, dried and was irradiated with ultraviolet rays for four minutes in a manner similar to that of the embodiment 5. This is called a substrate j. An admittance measured per unit area of the anodic oxidation layer of the substrate j obtained after the irradiation and the contact angle of pure water are as shown in Table 5. Thereafter, an electrophotography photoconductor was produced in a manner similar to that of the EXAMPLE 4, and this is called a drum J.

(COMPARATIVE EXAMPLE 5)

An anodic oxidation layer was formed and then seal processed in a manner similar to that of the EXAMPLE 4, and this layer was cleaned only with pure water. This is called a substrate k. An admittance measured per unit area of the anodic oxidation layer of the substrate k obtained and the contact angle of pure water are as shown in Table 5. Thereafter, an electrophotography photoconductor was produced in a manner similar to that of the EXAMPLE 4, and this is called a drum K.

(COMPARATIVE EXAMPLE 6)

An anodic oxidation layer was formed and then seal processed in a manner similar to that of the EXAMPLE 5, and this layer was cleaned only with pure water after carrying out an acceleration test. This is called a substrate l. An admittance measured per unit area of the anodic oxidation layer of the substrate 1 obtained and the contact angle of pure water are as shown in Table 5. Thereafter, an electrophotography photoconductor was produced in a manner similar to that of the embodiment 4, and this is called a drum L.

(COMPARATIVE EXAMPLE 7)

An anodic oxidation layer was formed and then seal processed in a manner similar to that of the EXAMPLE 6, and this layer was cleaned only with pure water after having been left for two months. This is called a substrate m. An admittance measured per unit area of the anodic oxidation layer of the substrate m obtained and the contact angle of pure water are as shown in Table 5. Thereafter, an electrophotography photoconductor was produced in a manner similar to that of the embodiment 4, and this is called a drum M.

TABLE 5

| Examples of | Sealing | UV irra- | Contact |
|---|---|---|---|

| production | | SUB. | condition | diation Time | Y ($S/m^2$) | Angle (°) | Drum |
|---|---|---|---|---|---|---|---|
| Example | 4 | h | 70° C./ 6 minutes | 2 minutes | 0.75 | 48 | H |
| | 5 | 1 | 70° C./ 6 minutes | 3 minutes | 0.42 | 56 | I |
| | 6 | j | 55° C./ 5 minutes | 4 minutes | 1.20 | 48 | J |
| Comparative example | 5 | k | 70° C./ 6 minutes | none | 0.37 | 84 | K |
| | 6 | l | 70° C./ 6 minutes | none | 0.18 | 95 | L |
| | 7 | m | 55° C./ 5 minutes | none | 1.12 | 84 | M |

*SUB.: Substrate *Y: admittance

The above-described aluminum substrates h to m were heated for sixty minute at 135° C. and then were suddenly cooled. This process was repeated by further two times and presence or absence of an occurrence of cracks was observed. A result of the observation is shown in Table 6. Further, the drums H to M were mounted on a page printer (manufactured by NEC), and image characteristics of the drums under various environments were evaluated. A result of the evaluation is shown in Table 7.

TABLE 6

| Examples of production | | Substrate | Heating test (135° C./60 min. × 3 cycles) | Heat resistivity |
|---|---|---|---|---|
| Example | 4 | h | No occurrence of cracks | ○ |
| | 5 | i | No occurrence of cracks | ○ |
| | 6 | j | No occurrence of cracks | ○ |
| Comparative example | 5 | k | Occurrence of cracks | X |
| | 6 | l | Occurrence of cracks | X |
| | 7 | m | No occurrence of cracks | ○ |

TABLE 7

| Examples of production | | Drum | Evaluation of image characteristics: 10° C./ 30% RH | 25° C./50% RH | 40° C./80% RH |
|---|---|---|---|---|---|
| Example | 4 | H | Satisfactory | Satisfactory | Satisfactory |
| | 5 | I | Satisfactory | Satisfactory | Satisfactory |
| | 6 | J | Satisfactory | Satisfactory | Satisfactory |
| Comparative example | 5 | K | Uneven coating with black points | Uneven coating with black points | Uneven coating with many black points |
| | 6 | L | Uneven coating with many black points | Uneven coating with many black points | Fogging and uneven coating with black points |
| | 7 | M | black points | Uneven thick and thin contrast with black points | Uneven thick and thin contrast with many black points |

TABLE 7-continued

Referring to Table 6 and Table 7, it is known that while no cracks occurred due to the heating in the substrates h to j and m, many cracks occurred in the substrates k an l. As a result of evaluating the image characteristics of images produced by using these substrates as conductors under various environments, there occurred uneven coatings in the drums K and L in which cracks occurred. Further, while black points were observed in all the images produced by using the drums onto which ultraviolet rays had not been irradiated, satisfactory images without any image defect were obtained under all the environments from the drums H to J onto which ultraviolet rays had been irradiated.

From the above-described results, it can be known that it is possible to remove a fine quantity of impurities which becomes an image defect when the surface is cleaned with a liquid and is also cleaned by an irradiation of ultraviolet rays as a pre-processing for forming a photoconductive layer on the aluminum substrate. Further, an irradiation of ultraviolet rays onto the surface of the anodic oxidation layer has an effect of recovering the layer to its original condition even if the heat-resisting property of the anodic oxidation layer has been deteriorated by a natural oxidization due to a lapse of time.

The heat-resisting property is deteriorated when the admittance of the anodic oxidation layer is less than 0.4 $S/m^2$, and cracks occur in this condition. The contact angle is a yardstick for checking the cleanliness of the surface of the substrate, and is also a guidance for checking the wettingness of the coating at the time of forming photoconductive layer. When the contact angle is smaller than 30°, absorption ability of the anodic oxidation layer becomes larger so that a contamination in the air can easily be adhered to the surface. This restricts the leveling of the coating and thus tends to cause an occurrence of a defect such as an uneven coating and black points. On the contrary, when the contact angle is larger than 80°, the adsorption ability becomes smaller and this tends to facilitate the leveling, but results in an occurrence of uneven coating or uneven thick and thin contrast despite trial changes in the coating density and coating speed in an attempt to keep the density of images.

As explained above, according to the present invention, it becomes possible to provide an electrophotography photoconductor which has a satisfactory heat-resisting property of the aluminum substrate and which has a satisfactory image free from any defect in chargeability and under all the environments when the range of the admittance of the anodic oxidation layer on the aluminum substrate to be used for the electrophotography photoconductor and the range of the contact angle are defined.

Further, it is possible to provide an electrophotography photoconductor which has a satisfactory heat-resisting property of the aluminum substrate and which has a satisfactory image free from any defect under all the environments when the aluminum substrate is irradiated with ultraviolet rays and when the ranges of the admittance of the anodic oxidation layer and the contact angle are defined.

What is claimed is:

1. A method for manufacturing a photoconductor for electrophotography, comprising the steps of:

forming an anodic oxidation layer on a conductive substrate;

sealing a surface of the anodic oxidation layer;

irradiating the sealed surface of the anodic oxidation layer with ultraviolet rays; and forming a photoconductive layer on the anodic oxidation layer.

2. The method according to claim 1, wherein, after irradiated with the ultraviolet rays, the surface of the anodic oxidation layer has a contact angle of pure water which is between 30 and 80° and an admittance which is at least 0.4 $S/m^2$.

3. The method according to claim 2, wherein the surface of the anodic oxidation layer is sealed by a nickel acetate solution.

4. The method according to claim 3, wherein the contact angle and the admittance are determined depending on a temperature of the nickel acetate solution and a sealing time.

5. The method according to claim 4, wherein the temperature is 50 to 75° C. and the sealing time is four to ten minutes.

6. The method according to claim 2, wherein the contact angle and the admittance are determined depending on a sealing temperature and a sealing time.

7. The method according to claim 1, wherein the surface of the anodic oxidation layer is sealed by a nickel acetate solution.

8. The method according to claim 1, wherein the conductive substrate includes a conductive material selected from the group consisting of aluminum and aluminum alloy.

9. A method for manufacturing a photoconductor for electrophotography, comprising the steps of:

forming an anodic oxidation layer on a conductive substrate including a conductive material selected from a group consisting of aluminum and aluminum alloy;

sealing a surface of the anodic oxidation layer by dipping said surface into a nickel acetate solution having an adjusted temperature for an adjusted time period;

cleaning the sealed surface of the anodic oxidation layer with liquid;

irradiating the sealed and cleaned surface of the anodic oxidation layer with ultraviolet rays; and coating a photoconductive material on the anodic oxidation layer to form a photoconductive layer.

10. The method according to claim 9, wherein, after irradiated with ultraviolet rays, the surface of the anodic oxidation layer has a contact angle of pure water which is between 30 to 80° and an admittance which is at least 0.4 $S/m^2$.

* * * * *